United States Patent [19]

Wilson

[11] Patent Number: 4,862,849

[45] Date of Patent: Sep. 5, 1989

[54] RPM ACTIVATED, POWERED LIMITER FOR PRESSURE TIME VEHICLE ENGINE FUEL SYSTEMS

[76] Inventor: Dallas W. Wilson, 2015 N.W. 23rd Ave., Portland, Oreg. 97210

[21] Appl. No.: 139,296

[22] Filed: Dec. 29, 1987

Related U.S. Application Data

[63] Continuation-in-part of Ser. No. 893,976, Aug. 7, 1986, abandoned.

[51] Int. Cl.[4] ..... F02B 77/08

[52] U.S. Cl. ..... 123/198 D; 123/333; 123/456

[58] Field of Search ..... 123/333, 332, 458, 459, 123/358, 359, 198 D, 456

[56] References Cited

U.S. PATENT DOCUMENTS

| | | | |
|---|---|---|---|
| Re. 30,203 | 2/1980 | Montgomery | 123/359 |
| 3,370,580 | 2/1968 | Vnok | 123/333 |
| 3,659,113 | 4/1972 | Wagner | 123/198 D |
| 3,893,168 | 7/1975 | McBride | 123/198 D |
| 4,023,549 | 5/1977 | Hewlitt | 123/198 D |
| 4,080,940 | 3/1978 | Fuzzell | 123/333 |
| 4,156,560 | 5/1979 | Cherlich | 123/456 |
| 4,245,598 | 1/1981 | Ruhl | 123/198 D |
| 4,305,353 | 12/1981 | Robinson et al. | 123/333 |
| 4,403,580 | 9/1983 | Bader | 123/198 |
| 4,404,939 | 9/1983 | Kinzl et al. | 123/333 |
| 4,489,311 | 12/1984 | Lang | 123/198 D |
| 4,619,231 | 10/1986 | Stolar et al. | 123/333 |
| 4,653,445 | 3/1987 | Book | 123/198 D |

FOREIGN PATENT DOCUMENTS 56-75847 11/1982 Japan .

*Primary Examiner*—Carl Stuart Miller
*Attorney, Agent, or Firm*—Eugene M. Eckelman

[57] ABSTRACT

An electrically operated counter is associated with a valve communicating with fuel feed mechanism of a diesel engine. The valve has a first position which allows normal fuel flow to the engine and has a second position allowing only partial fuel flow to the engine. An electrically operated control is activated by the counter at a selected RPM reading of the counter to move the valve to its second position to reduce fuel flow to the engine and consequent reduction of power. The control has a delay therein for delaying operation of the valve for a selected interval after the RPM of the engine has reached the RPM setting of the counter. Activation of the delay is made apparent to the operator by a signal energized simultaneously with initial actuation of the delay. A signal may also be employed that is activated prior to the delay and its signal to warn the operator of impending governing functions.

2 Claims, 2 Drawing Sheets

RPM ACTIVATED, POWERED LIMITER FOR PRESSURE TIME VEHICLE ENGINE FUEL SYSTEMS

REFERENCE TO PRIOR APPLICATIONS

This application is a continuation-in-part of Ser. No. 893,976, Aug. 7, 1986 and now abandoned.

BACKGROUND OF THE INVENTION

This invention relates to new and useful improvements in governors for vehicle engines and more particularly is concerned with means to limit powered RPM's in pressure time vehicle engine fuel systems.

Various types of governors have been employed to control upper speed limits of vehicles for safety, for fuel economy, for protection of mechanical portions of the vehicle, for complying with governmental or management regulations, and for other reasons. Some devices heretofore used shut down the power by stopping the fuel flow when a selected vehicle or engine speed is reached. This type of system has the disadvantage of providing only "on and off" control over the power means. Such has been found to be detrimental to the drive train of the vehicle and also makes driving difficult. That is, an on-off control causes a sudden, stressful reaction, or backlash, on the drive elements of the vehicle and such causes damage to the mechanism as well as reducing driver control, especially under slippery road conditions. Other governors utilize mechanisms which adjust fuel flow according to the speed of the vehicle. Such speed control may result in compliance with required conditions, but here again there may be backlash and reduction of driver control. Driver control of a vehicle is very important, particularly for trucks. Many prior devices also have the disadvantage of being complicated and thus expensive.

SUMMARY OF THE INVENTION

The present invention operates as an RPM limiter for an internal combustion engine of the type utilizing a pressured fuel feed system with return means for bypass fuel, the bypassed fuel being fed to the fuel tank or other holding means which is at atmospheric pressure or at least at a pressure lower than the fuel feed system. The invention is especially adaptable to diesel engines which use a pressure-time type of fuel system and which have a primary governing mechanism to maintain an idle speed and to limit the RPM of the engine to a predetermined maximum. The so-called pressure time fuel metering system accomplishes its metering by means of an externally mounted pump in combination with a metering orifice in mechanically actuated injectors.

A primary objective of the invention is to provide an auxiliary governing mechanism which at a selected RPM of the vehicle engine or drive line, in all gears, reduces the flow of power producing fuel but does not fully cut it off. The system utilizes delay mechanism activated by RPM counting means to delay activation of the governing mechanism.

Another object of the invention is to provide an embodiment of the invention which utilizes electrically operating RPM counting means of the vehicle engine or drive line and associated valve means arranged to be associated with the pressured fuel feed system and a lower pressure return means. Electrically operated control means are activated by the counter means at a selected RPM to allow some of the pressured fuel to bypass the fuel feed means, thus reducing the flow of power producing fuel.

Another object of the invention is to provide an RPM limiter which in another embodiment is arranged to be adapted for use with a manual fuel flow override in fuel pumps.

It is another object of the invention to employ signal means for alerting the operator of impending power reduction. Said signal means in one embodiment employs a signal that is activated simultaneously with activation of the delay mechanism whereby to alert the operator that the power producing fuel will be reduced at the end of the delay period. In another embodiment, a companion signal is employed which is activated a short time prior to the delay indicating signal, thus warning the operator that he is approaching the governing function.

In carrying out the objectives of the invention, electrically operated adjustable counting means are used to count the individual revolutions of vehicle rotating mechanism, such as an engine, or by association with flywheel rotation, or to count the individual revolutions of the drive line by association of the transmission output shaft. Means are provided which are movable by electrically operated control means to reduce the flow of power producing fuel. The electrically operated control means are activated by the counting means at a selected RPM setting of the counting means to move the fuel reducing means from an inoperative position to an operative position whereby to reduce the flow of power producing fuel t the engine. The system includes adjustable delay means which delay operation of the control means for a selected interval after the RPM of the rotating mechanism has reached the RPM setting of the counting means as pre-set to activate the secondary governing mechanism. Signal means in the operator's compartment is provided which is activated simultaneously with activation of the delay to give the operator of the vehicle a warning that he is nearing power reduction and that the RPM must be reduced to avoid power reduction. Also, another signal may be provided that is activated just prior to activation of the delay signal.

The invention will be better understood and additional objects and advantages will become apparent from the following description taken in connection with the accompanying drawing.

DETAILED DESCRIPTION OF PREFERRED EMBODIMENTS

Figure 1:
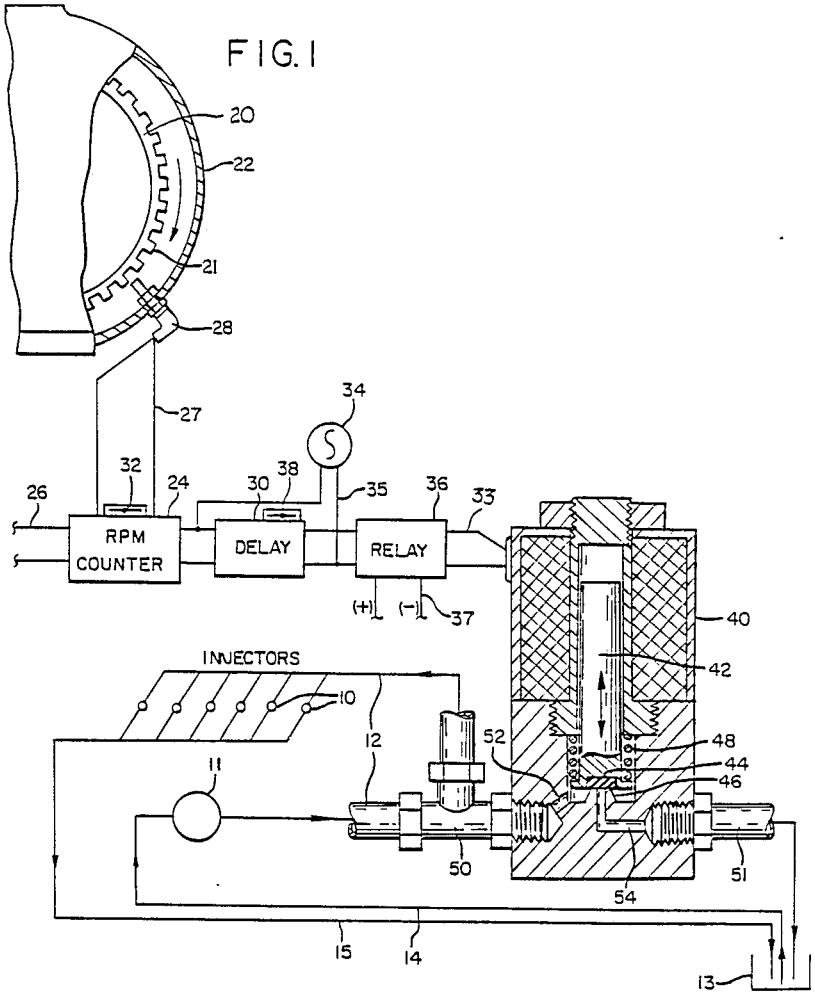
FIG. 1 is a diagrammatic view of a first form of powered RPM limiter and signal means embodying features of the invention, this view also showing a first form of vehicle fuel system.

As noted above, the present RPM limiter is utilized in combination with a vehicle fuel feed system which operates under pressure and which has return means from injectors for bypass fuel leading to a source which is of lower pressure than the fuel feed, such as to the fuel tank. A fuel system of this type, as embodied in an engine (not shown) is diagrammatically shown in FIG. 1 which illustrates a first embodiment of the invention. Conventionally, an engine utilizes injectors 10 connected to a pump 11 by a fuel line and common manifold 12. The pump draws fuel from a tank 13 through a suction line 14. Unused fuel is returned from the injectors to the tank via a return line 15 with its attendant collecting manifold. The flywheel 20 of the engine has gear teeth 21 on its outer periphery and is encased in a flywheel housing 22.

According to the embodiment of FIG. 1, an electrically operated engine speed or RPM counter 24 is incorporated in an electrical circuit 26 and is associated with an electro-magnetic pickup 28 (positioned at the teeth of the flywheel) in the circuit which accurately reads and reports flywheel rotational speed to the RPM counter 24 via circuit 27. Such counter converts the flywheel speed into engine RPM in a well-known manner. RPM counter 24 has conventional internal circuitry which operates to activate a delay 30 at a selected RPM setting, such counter having external adjustment mean 32 for making preselected settings.

The counter 24 also controls activation of a signal device 34 in a circuit 35 and located, typically in the operator's compartment, to alert the operator that the selected overspeed RPM has been reached. This signal may comprise a visual signal such as a red light, or it may comprise an audio signal, or both. The delay 30 controls operation of an electrically actuated relay mechanism 36 arranged when energized to connect an output circuit 33 with a power supply circuit 37 but only after a selected time lapse as controlled by the delay 30. The delay has adjustment means 38 for setting its function to selected delay times. The delay and adjustment circuitry therefor are of conventional design. Signal 34 and delay 30 are activated simultaneously.

Relay 36 controls the operation of a solenoid actuated valve 40 having a plunger 42 with a valve end 44 engageable with a valve seat 46 within the valve 40. Plunger 42 is normally held in a closed position by a compression spring 48 but is capable of being lifted against the action of this spring by the solenoid-generated force when the circuit 33 is connected to circuit 37.

The valve 40 is connectably inserted between the pressured fuel line 12 and the fuel tank 13 by suitable fittings 50, 51 and provides controlled communication between these fittings and through the valve 40 by passageways 52 and 54. These passageways are of reduced size relative to the size of fuel line 12 for a reason now to be explained.

According to the present arrangement, the normal pressured operation of the fuel system comprising elements 10 through 15 is not affected when the valve 40 is closed. Pressure to the injectors 10 is thus maintained at the level controlled by the pump 11 for normal powered operation. However, in the event that the solenoid valve 40 is energized, a flow of fuel occurs through the valve and return line 15 to the tank 13. This opened bypass circuit in the fuel supply system causes a reduction of pressure in the fuel line 12 and a consequent reduction of fuel injected into the engine by the injectors 10 to thus lower the power of the engine. The amount of pressure reduction to the injectors depends upon the volume of flow through the passageways 52 and 54. The flow resistance for example, one-half the volume of the fuel line 12, is preselected to accomplish the desired power reduction but with fuel still being supplied to the injectors at the desired reduced flow. Thus, with the valve 42 open, the power output of the engine is reduced and the vehicle speed will reduce to accomplish a governing function.

In the operation of the FIG. 1 embodiment, the RPM counter 24 is set selectively to the RPM setting at which it is desired that the vehicle not be operated at or above. The limiter will limit powered RPM in all gears or selected gears. When the vehicle reaches such RPM setting, the delay 30 and signal 34 are activated which in turn causes signal 34 to warn the driver that the governor is now under control of the delay. Relay 36 will be energized after the selected time delay has elapsed unless the RPM's are lowered. Thus, the operator is made aware that within the time set in the delay the engine power is going to be lessened. The operator can then, if accelerating by progressive gear shifting, up-shift in a normal manner to the next higher gear which reduces the RPM and avoids the power reduction. If in top gear and the delay 30 and signal 34 are activated, the operator is then warned that a power reduction is imminent and a slight slowing of RPM/MPH will occur before full power is available again. The delay also allows the operator to have full power during the delay period. Thus, the operator can judge when to make the shift so that there will not be unnecessary or unexpected slowing of the vehicle when shifting gears. Braking may be required, according to road grade, to be in compliance with speed or other regulations. The governing system shuts off when the RPM's are reduced below the setting of RPM counter 24.

Figure 2:
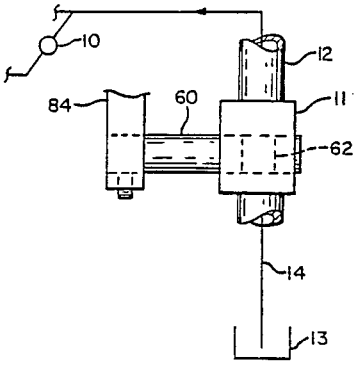
FIG. 2 is a diagrammatic view of another form of fuel system with which the broad concept of the invention may be employed.
Figure 3:
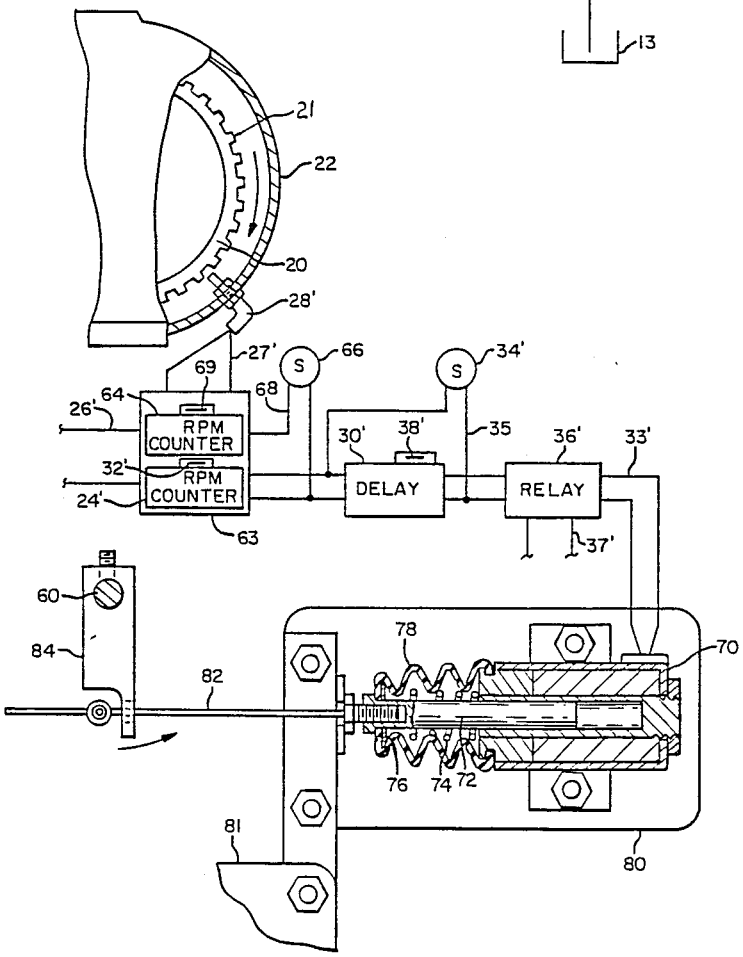
FIG. 3 is a diagrammatic view of an embodiment of the invention used with the fuel system of FIG. 2, this view also including a further form of signal means.

FIGS. 2 and 3 illustrate a second embodiment of the invention. This embodiment has the same purpose as the embodiment of FIG. 1, namely, to provide a controlled reduction of the flow of power producing fuel. It is used, however, with a fuel system using an existing operator-controlled fuel flow override shaft associated with the fuel pump. FIG. 2 illustrates the usual diesel fuel components with which this embodiment is used, comprising injectors 10, pump 11, fuel lines 12, fuel tank 13, and suction line 14. The existing operator controlled override shaft is shown diagrammatically and comprises a rotary type member 60 having a metering orifice 62 which is associated with the pump 11 to allow full flow of the engine fuel for normal operation or to control the flow. Rotary valve member 60 projects from the pump so as to be connectable to the conventional operator shutoff mechanism or to the present governor, or both, to be described and in its usual structure requires forced rotation in one direction but has spring return.

This second embodiment is arranged to rotate the rotary valve member 60 a selected amount, as controlled by RPM's, for reducing fuel flow and thus serving, as in FIG. 1, as an auxiliary governor. It has dual counter means 63 which also similar to FIG. 1 employs an electrically operated engine speed or RPM counter 24' incorporated in an electrical circuit 26' and associated with an electromagnetic pickup 28' accurately reading and reporting rotational speed to the counter 24' via a circuit 27'. RPM counter 24' has conventional internal circuitry which activates a delay 30' at a selected RPM setting and includes external adjustment means 32' for making preselected settings. Also, the counter 24' controls operation of a signal device 34' which alerts the operator that the selected overspeed RPM has been reached. The delay 30' controls operation of an electrically actuated relay mechanism 36' arranged when energized to connect an output circuit 33' with a power supply circuit 37' but only after a selected time lapse as controlled by the delay 30'. Delay 30' has adjustment means 38' for setting its function to selected delay times. Signal 34' and delay 30' are activated simultaneously.

Dual counter means 63 includes a second counter 64 electrically connected to another signal 66 by circuitry 68. Counter 64 is arranged to activate signal 66 at a slightly lower count than counter 24 thus warning the operator of nearing activation of delay 30' and signal 34' resulting in reduced power. Such reduced power can be avoided by holding or slightly reducing RPM below the overspeed setting of the counter 24'. RPM counter 64 has adjustment means for controlling activation of the signal means 66 at a selected RPM.

Mechanism responding to operation of the relay 36' comprises a solenoid 70 connected into the circuit 33' and having a plunger 72 normally held outwardly by a compression spring 74 engageable between a washer 76 threaded on the end of the plunger and the housing of the solenoid. The projecting end of the plunger 72 and the spring are confined within a bellows-type cover 78.

Solenoid 70 is adjustably mounted on a base 80 in turn having a bracket 81 thereon which suitably secures it on a vehicle engine in the area of the rotary member 60. The end of plunger 72 is fitted with a pull cable 82 and the end of this cable is adjustably connected to a lever 84 in turn secured non-rotatably to the rotary valve member 60, whereby upon energization of the solenoid 70, plunger 72 draws inwardly and rotates the lever 84 in a counterclockwise direction as viewed in FIG. 3 and controls the flow of fuel by means of metering orifice 62 through the fuel line 12. More particularly, in the deenergized condition of the solenoid, fuel flow through the manifold is uninterrupted. In the energized condition thereof, however, the lever 84 will rotate the rotary valve member a selected amount to reduce the flow of power producing fuel. The extent of reduction of fuel flow is predetermined the same as is accomplished by the valve 40 in FIG. 1 whereby power is reduced but not fully shut off. The amount of rotation of rotary valve member 60 to the position of reducing fuel flow is accomplished by the length of throw of the solenoid plunger 72 and suitable adjusted mounting of the solenoid on its base or by adjusted connection of lever 84 with the cable.

In operation of the embodiment shown in FIGS. 2 and 3, solenoid 70 by means of its pull cable 82 is selectively connected to the rotary valve member 60 such that in the deenergized or rest position of the solenoid full or normal fuel flow occurs through the fuel line 12, namely, the metering orifice 62 is fully open. When the solenoid is energized, however, it rotates the valve member 60 selectively to provide the reduction in power producing fuel flow. With the exception of the signal 66, to be described, the system works exactly the same as that described in connection with the FIG. 1 embodiment, namely, the RPM counter 24' is set selectively to the RPM at which it is desired that the vehicle RPM be controlled and when the vehicle reaches this RPM setting, the delay 30' and signal 34' are activated and relay 36' is energized after the selected delay time has lapsed for energizing the solenoid 70. Similarly, the operator is made aware that within the time set in the delay the engine power is going to be lessened and he can take necessary steps to operate the vehicle in an efficient manner.

Since RPM counter 64 is activated at an RPM less than RPM counter 24' the operator is always made aware beforehand, for example, two or three seconds, that the governing system is going to be activated. Signal 66 can be of any desired type such as visual, audio, or both and would be located adjacent to signal 34' in the operator's compartment. As an example, signal 66 may be yellow and signal 34' may be red. Signal 66 thus gives the operator the choice whether or not to stay in compliance with the pre-set regulations. If the operator does not heed the warning, the governing system will be activated. The governing system shuts off when RPM's are slightly reduced below the setting of RPM counter 24'. Lever 84 and solenoid plunger return to their normal position by the spring return means associated with rotary valve member 60 and also by solenoid spring 74 if such is necessary.

The embodiment of FIG. 1 could also incorporate the second signal 66 therein.

Not only does the present invention encourage compliance with governmental and other regulations but also through its delay the operator can, as noted, maintain good vehicle operation.

Availability of the RPM limiter, in all gears, to avoid prolonged high RPM engine operation is vital to fuel consumption and engine life even though the vehicle is not necessarily operating at a high MPH. It is common knowledge that considerable savings can be experienced at the lower RPM's. Since the power to the engine is reduced rather than shut off completely, there is no backlash generated in the drive train of the vehicle. The system works in all powered conditions of the engine and in all gears.

It is to be understood that the forms of my invention herein shown and described are to be taken as preferred examples of the same and that various changes in the shape, size and arrangement of pars may be resorted to without departing from the spirit of my invention, or the scope of the subjoined claims.

Having thus described my invention, I claim:

1. An RPM limiter for vehicles having an engine of the type with a pressured power producing fuel feed system and bypass fuel means leading to a lower pressure source than the fuel feed system, said limiter comprising:

electrically operated counting means arranged to count RPM's, valve means arranged to be connected for communication between the power producing pressure fuel feed system and the lower pressure source, said valve means having a first position closing off pressured fuel flow to the lower pressure bypass means for making full power fuel flow available in said fuel feed system and having a second position directing some of said pressured fuel to said lower pressure source for accomplishing reduced but power producing fuel flow in said fuel feed system, electrically operated control means activated by said counter means at a selected RPM reading of said counting means to move said valve means to its second position whereby to relieve part of the pressure from the pressured fuel feed system to said lower pressure source and thus partially reduce pressured flow to the engine and consequent partial reduction of power, said counting means being adjustable for providing selected RPM settings thereof, said control means comprising electrically operated delay means for delaying operation of said valve means and said reduced but power producing fuel flow in said fuel feed system for a selected interval after the RPM has reached the RPM setting of said counting means, first electrically operated driver signal means energized simultaneously with initial activation of said delay to warn the driver of the vehicle that said delay is in progress, and second electrically operated driver signal means energized by said counting means at a selected interval prior to the activation of said delay to warn the driver of the vehicle that said delay and said first mentioned signal means will be activated following said interval.

2. An RPM limiter for use on a vehicle having an internal combustion engine of the type having a power producing fuel feed system incorporating a fuel pump with rotatably adjustable fuel flow override means, said limiter comprising:

electrically operated counting means arranged to count RPM's, fuel flow control means arranged to be connected to the rotatably adjustable fuel flow override means, said fuel flow control means having a first position arranged to rotatably position the override means for making full power fuel flow available to the engine and having a second position arranged to rotatably adjust the override means for directing partial fuel flow to the engine and accomplishing reduced but power producing fuel flow to said engine to limit RPM's, electrically operated control means activated by said counter means at a selected RPM reading of said counting means to position said fuel flow control means in its second position whereby to provide said partial reduction of flow of power producing fuel and consequent partial reduction of power, electrically operated delay means for delaying operation of said fuel flow control means and said reduced but power producing fuel flow to said engine for a selected interval after the RPM has reached the RPM setting of said counting means, first electrically operated driver signal means energized simultaneously with initial activation of said delay to warn the driver of the vehicle that said delay is in progress, and second electrically operated driver signal means energized by said counting means at a selected interval prior to the activation of said delay to warn the driver of the vehicle that said delay and said first mentioned signal means will be activated following said interval.

* * * * *